US006083080A

United States Patent [19]

Lawson et al.

[11] Patent Number: 6,083,080

[45] Date of Patent: Jul. 4, 2000

[54] PROTECTIVE BRASSIERE WITH LOCAL ENERGY ABSORPTION

[76] Inventors: LaJean Lawson, 12528 SE. Winston Rd., Boring, Oreg. 97009; Hinda Miller, 84 DeForest Heights, Burlington, Vt. 05401

[21] Appl. No.: 09/255,726

[22] Filed: Feb. 23, 1999

[51] Int. Cl.[7] ..... A41C 3/00

[52] U.S. Cl. ..... 450/39; 450/54

[58] Field of Search ..... 450/39, 40, 43, 450/44, 53, 54, 57, 1; 2/455, 463

[56] References Cited

U.S. PATENT DOCUMENTS

| | | | |
|---|---|---|---|
| 2,445,767 | 7/1948 | Dickerson | 450/1 |
| 2,579,365 | 12/1951 | Conde | 450/1 |
| 3,176,686 | 4/1965 | Barnes | 2/455 |
| 3,446,213 | 5/1969 | Goldman | 450/39 |
| 3,478,739 | 11/1969 | Librande | 2/455 |
| 4,566,458 | 1/1986 | Weinberg | 450/1 |
| 4,607,640 | 8/1986 | McCusker | 450/39 |
| 5,022,887 | 6/1991 | Lawson | 450/54 |
| 5,032,103 | 7/1991 | Larrson | 450/37 |
| 5,244,432 | 9/1993 | Moy Au et al. | 450/54 |

*Primary Examiner*—Gloria M. Hale
*Attorney, Agent, or Firm*—Browdy and Neimark

[57] ABSTRACT

A sports brassiere provides impact protection with rigid cups of polyethylene, lined inside (and preferably outside) with closed-cell foam, such as neoprene. The foam reduces injury by absorbing impact energy. The inner layer is compressed over a large area and, therefore, absorbs more energy. The neoprene layers extend beyond the periphery of the rigid cups and are glued to the respective surfaces of the cups within the periphery of the cups and are glued to one another outside the periphery of the cups, using waterproof glue. Two layers of thin nylon are bonded to the neoprene layers. Since the laminate absorbs no water, it is easily dried after washing.

17 Claims, 2 Drawing Sheets

PROTECTIVE BRASSIERE WITH LOCAL ENERGY ABSORPTION

BACKGROUND OF THE INVENTION

1. Field of the Invention

The invention relates to brassieres with shock-absorbing energy absorption, useful for athletic and industrial use. More particularly, the present invention relates to such brassieres which are easy to wash and dry.

2. Review of the Related Technology

In body contact sports, such as martial arts, basketball, football, hockey, and soccer, there is a need to protect women's breasts from injuries which result from impact. The risk to the breast is both short-term and long-term. Injuries can lead to later infections, cysts, and benign tumors. In addition, women can concentrate and perform better when their breasts are protected from potential injury and discomfort, reducing their worry.

A protective brassiere used for sports gets sweaty and should be easy to wash and dry, but conventional hard protective brassieres are not.

Some protective brassieres use cellular plastic to absorb impact. Cellular plastics are of two types, closed-cell and open-cell. Open-cell foams are sponge-like materials, e.g., polyurethane. These absorb a great deal of water or sweat and provide comfort as a sweat absorber in brassieres. However, since they are so absorbent, they also dry slowly; in order to dry efficiently, such a spongy material should be wrung out and exposed to air on both sides.

This means that open-cell foam is not suitable to be combined with a solid plastic layer in a protective brassiere unless the foam is removable so that it can be squeezed or spun and then dried. Closed-cell foams (for example, neoprene) are easy to dry because they are not water-absorbent. Neoprene is the generic name for polymerized chloroprene. Only the surface can be wetted, and the surface is easily dried. However, if a closed-cell foam is combined with a solid plastic sheet, when the brassiere is washed, water will seep between the two impervious layers and stay there, which might lead to bacteria growth and foul odors.

Several previous workers have developed impact-resisting brassieres.

Weinberg, U.S. Pat. No. 4,566,458 discloses (FIG. 8) a removable hard brassiere cup 12 and an inner liner 16, which is fibrous (column 2, line 66). A polyester foam cushion 50 is attached to the rim for comfort and softness, not for protection (column 3, line 28).

McCusker, in U.S. Pat. No. 4,607,640, shows a brassiere with rigid cups which are removable.

In Weinberg and McCusker, the breast protectors are designed for fitting into individual pockets located in a brassiere. Each uses a rigid cup and attempts to distribute an impact force around the perimeter of the cup by designing the cup to follow the contour of the curve of the thorax of the wearer. The object of these designs is to transmit an impact force around the breast, into the rib cage and sternum of the wearer.

In these prior art designs, where the protector contacts the thorax all the way around the breast at all times, the force of a blow is transmitted directly to the thorax. There is no provision for absorbing a portion of the impact by any means other than direct transmission of the impact to the chest along the shell of the rigid cup protector. The cups must be very rigid to resist any inward deformation and are heavy.

In prior art designs, such as Weinberg and McCusker, two separate pockets are formed to hold the hard cups. These separate pockets are separated by a stitching along the center of the brassiere on the front.

U.S. Pat. No. 2,897,821 to Lerner discloses a brassiere sandwich of fabric/closed-cell foam/fabric at column 2, lines 13–15, and specifies the closed-cell foam as ENSOLITE, at column 2, line 19. ENSOLITE is a trade mark for expanded polyvinyl chloride.

Barnes, U.S. Pat. No. 3,176,086, shows brassiere cups 54 and 56 of polyethylene, covered with a resilient shock absorbing cover 72 of cellular plastic (column 2, line 60). Bent portions 76, folded over the cup rim, are fastened along the inside edge with snaps 78. The snaps meet Barnes' object of a brassiere that is readily disassembled for easy cleaning (column 1, line 22). Apparently, the snaps are placed on the inside for appearances' sake, and the bent portion is provided only for snap attachment.

U.S. Pat. No. 5,244,432 to Moy Au et al describes rigid cups 15 with shock-absorbing rims 18 made of rubber or other shock-absorbing material, which are removable and quick-drying (column 3, lines 24–37).

Leo et al, in U.S. Pat. No. 2,516,129, shows a breast protector with a rigid plastic cup (column 3, line 74) and a front cushion of trapped air or cellular rubber material (column 4, line 4) or sponge rubber (column 4, line 57).

Lawson, U.S. Pat. No. 5,022,887, shows a rigid-cup brassiere which provides an air space between the breast and the inside of the cup. This space, or distance $d_3$, is shown in FIG. 5. The gap is created by making the inner fabric liner 28 smaller than the cup, so that the liner closely supports the breast (column 4, lines 58–63). Distance $d_3$ provides a ffer zone in case of impact; the inside of the rigid cup can move across the gap as the cup deforms under impact, absorbing energy, before the breast is contacted (column 5, lines 21–39). The two rigid cups overlap in the sternum area, and this also absorbs impact force by allowing either cup to deform under impact and slide over the other (column 6, lines 1–17).

SUMMARY OF THE INVENTION

Conventional protective sports brassieres, such as those above, do not properly make use of foam materials to both decrease drying time and reduce impact force.

Foam materials, whether open-cell or closed-cell, are compressible and thereby able to absorb the energy produced by an impact. However, the force needed to compress a layer of material is, of course, proportional to the area compressed. Conventional protective brassieres place foam only over the outer surface of a rigid cup. In case of impact by a small object, the energy absorption is also small since only a small area of the foam covering is compressed. This limits the protection afforded by the foam.

Second, the advantages of closed-cell foam for quick drying are not realized. Brassieres typically use nylon or other synthetic fabrics, which are hydrophobic and dry very quickly. Closed-cell foam also dries in mere minutes and, therefore, is a logical choice for a garment that needs frequent washing and is conveniently hung up to air-dry. If closed-cell foam is not arranged to trap water and is covered only by conventional thin nylon lining material, it will dry very quickly. However, it is not so used in conventional protective brassieres.

Accordingly, the present invention has an object, among others, to overcome deficiencies in the prior art such as noted above.

The invention relates to a protective brassiere with semi-rigid or rigid cups of polyethylene lined with energy-absorbing layers of closed-cell foam, preferably on both sides of the polyethylene cup. The closed-cell foam acts to absorb energy both locally and over a larger area, as explained below.

The neoprene/polyethylene/neoprene sandwich is not removable from between the two sheathing layers of nylon, but the brassiere dries quickly after hand washing because of the closed-cell nature of the foam. The foam is preferably glued with waterproof adhesive to the rigid, waterproof cup to form a laminate, so that water cannot be trapped between them to delay drying. The layers of foam are glued to one another outside the periphery of the rigid cup, and the foam is also bonded to the nylon. In this manner, moisture cannot penetrate into the inner layers of the brassiere. Adhesive avoids the need for snaps and similar fasteners which can break, cause irritation, and the like.

If the foam lining of the rigid cup were spongy open-cell foam, it would need to be removable from the rigid shell for drying because it would need to be wrung out. Therefore, the brassiere would need pockets, which would increase the cost and complexity of the brassiere and make it less convenient to use.

Furthermore, permanently fixing the cups within the brassiere means that they are prevented from the shifting which can occur in prior art brassieres in which the cups are maintained in pockets. This is important in protecting the breast from being injured by the equipment itself, which can happen if the hard cups do not stay correctly positioned.

The rigid cup, and accompanying foam layers, optionally extend upward and to the sides substantially beyond the breast area. Energy absorption by the neoprene foam supplements the distribution of impact force over the peripheral portions of the polyethylene cup.

Because the energy-absorbing foam covers both sides of the rigid shell, the impact protection is increased.

On the outside, the foam absorbs the energy of impacting objects, especially large objects, such as a softball or a player's arm. The larger the area of outside foam that is compressed, the greater the amount of energy that is absorbed.

On the inside, the foam is also effective because the brassiere, if properly sized, is completely filled with breast tissue, which, while soft and deformable, is relatively incompressible as compared to plastic foam. Breast tissue does not have the numerous gas pockets that foam has. This means that an impact which forces the rigid shell against the ribs and breast will result in a compression of the inside layer of foam at the moment of impact; the inward motion will increase the pressure on the breast tissue, and this increase in pressure will compress the foam, further absorbing energy.

The high pressure will not result in substantial discomfort or injury to the breast tissue because there is no stretching or tearing of one portion relative to another, and no very high pressure which could cause a bruise. At sea level, air constantly pushes on each square inch of the breast with a force of 15 pounds, which would be enough to cause severe discomfort if localized and restricted to just one small area. Because this force is applied evenly, there is no discomfort at all.

The present invention works on the same principle. The rigid shell spreads a local impact force over the entire breast. As the rigid shell moves inward, the pressure in the breast tissue is increased, but there is no significant distortion of the breast and so no injury. As the pressure rises the foam between the breast and the shell is compressed, and it absorbs much of the impact energy.

In the case of sudden and severe impacts, such as, for example, when the breast is hit with a batted baseball, the inner liner also works locally. A sudden, severe impact will, of course, cause minor deformation of the rigid shell, which will be slight but also fast. The protective layer of foam on the inside of the rigid cup will compress as the shell moves toward the skin and the inertia of the breast tissue resists the sudden motion. This reduces the motion imparted to the breast and increases the amount of protection provided by the same thickness of plastic in the rigid cup.

Even if the breast is not in contact with the inner layer of foam at the moment of impact, the invention still provides additional protection because the impact force will soon press the brassiere over the breast.

BRIEF DESCRIPTION OF THE DRAWING FIGURES

The above and other objects and the nature and advantages of the present invention will become more apparent from the following detailed description of an embodiment taken in conjunction with drawings, wherein.

DETAILED DESCRIPTION OF THE PREFERRED EMBODIMENT

Here, and in the following claims:

"Rigid" means capable of maintaining a predetermined shape, under ordinary forces, such as that of gravity, but does not require or preclude other material properties, such as plasticity or resilience, brittleness, coefficient of restitution, or any other quality of materials, from being present or absent from the "rigid" object.

"Unitary" means without any means for being dissembled, i.e., not knock-down and not to be taken apart without damage.

"Integral" means formed of or including at least one single piece of material.

"Laminate" means a sandwich having layers or lamina bonded together (by adhesive, heat, vibration, etc.) over at least a part of their overlapping or contiguous area.

Figure 1:
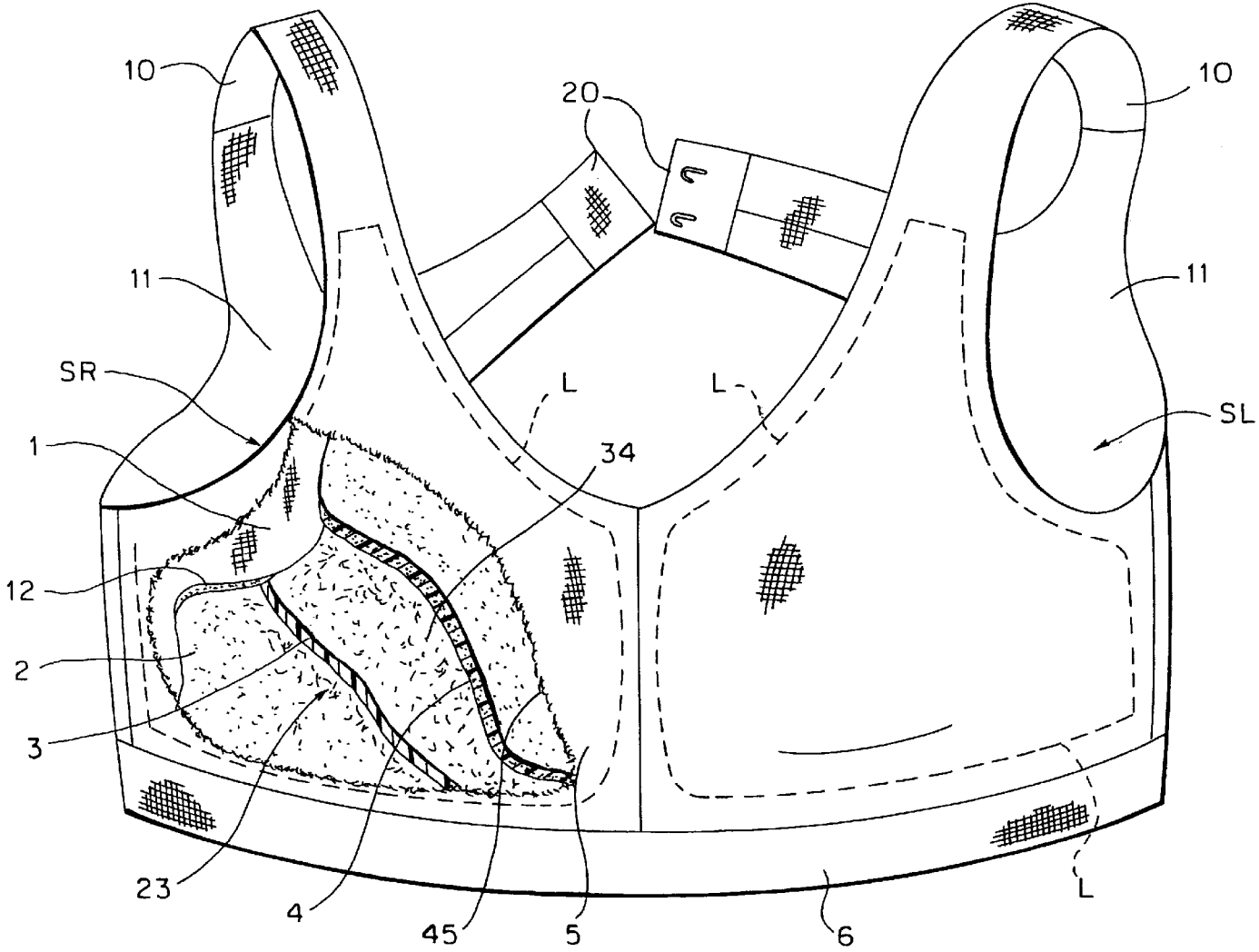
FIG. 1 is a perspective view of the invention.

Referring to FIG. 1, a brassiere is shown with shoulder straps 10 and back straps with clasps 20. As the straps 10 pass over to the back they meet an area 11, preferably of stretch fabric to provide the elasticity needed for comfortable wear. This area 11 may optionally be continuous with the elastic rib band or anchoring band 6 stretched around the chest and fastened by the clasps 20. The band 6 provides a supportive base for the cups and prevents the cups from riding up. Hook-and-loop fasteners or other fastening devices may be used in place of clasps for the rib band and may also be used to make the shoulder straps 10 adjustable (not shown).

In the front of the brassiere, right and left breast portions, SR and SL, are provided. These portions are constructed of an inner 1 and outer 5 sheathing layer of nylon fabric. Between the sheathing layers 1 and 5 are two layers of closed-cell foam, such as neoprene, i.e., inner layer 2 and outer layer 4. Between the two foam layers 2, 4, in the area within the peripheral dotted lines L, is a rigid cup 3, preferably of polyethylene. The nylon fabric of the sheaths 1, 5 is bonded to the closed-cell foam of the layers 2, 4 beneath them. In the areas where the rigid cup 3 is present, the two layers of foam 2,4 are glued to respective sides of the cup 3 by waterproof adhesive 23, 34. Adhesive layer 23 glues foam layer 2 to the inner side of cup 3 t and adhesive layer 34 glues the foam layer 4 to the outer side of the cup, 3. Beyond the periphery of the cup 3, including the shoulder strap region 10, the two foam layers 2, 4 are glued to one another so that no moisture can penetrate into the inner layer of the brassiere. See adhesive layer 24 in FIG. 2.

The nylon sheath layers 1, 5 may be bonded to the foam layers 2, 4 in any manner known in the art to form a laminate, such as by heat, vibration, adhesive, etc. In FIG. 1, a film 12 of waterproof adhesive is shown between the layers 1 and 2, and a film 45 of waterproof adhesive is shown between the layers 4 and 5.

Any conventional fabrics other than nylon, and any sort of closed-cell foam other than neoprene, can also be users in the invention. Stretch fabric is preferable for the outermost layers 1 and 5.

Optionally the outermost layers 1 and 5 are adhered to the foam layers 2 and 4 by layers of waterproof adhesive 12 and 45, as described above, or other means of bonding. In an alternative embodiment, the outer fabric layers 1,5 are not bonded to the inner sandwich of foam/plastic/foam, but instead are sewn or otherwise closed over the sandwich to hold it firmly in place. If they were to move out of position, rigid cups could worsen the effects of an impact or may themselves injure the wearer. In the preferred embodiment in which the outer fabric layers are bonded to the foam, there is no motion of the cups out of their correct positions.

The rigid portion of the cup, including the bonded sandwich or laminate of fabric/foam/plastic/foam/fabric 1/2/3/4/5 or foam/plastic/foam 2/3/4, preferably extends over the main portion of the breast and some distance up toward the shoulder; an exemplary outline is indicated in FIG. 1 by the dashed line L. Outside the area marked by dashed line L, the preferred laminate structure lacks the plastic cup and includes a fabric/foam/foam/fabric sandwich 1/2/4/5, which is, of course, more flexible. The straps 10 preferably include this sandwich structure; optionally, the straps 10 may include only fabric, or any other structure of sufficient tensile strength.

Figure 2:
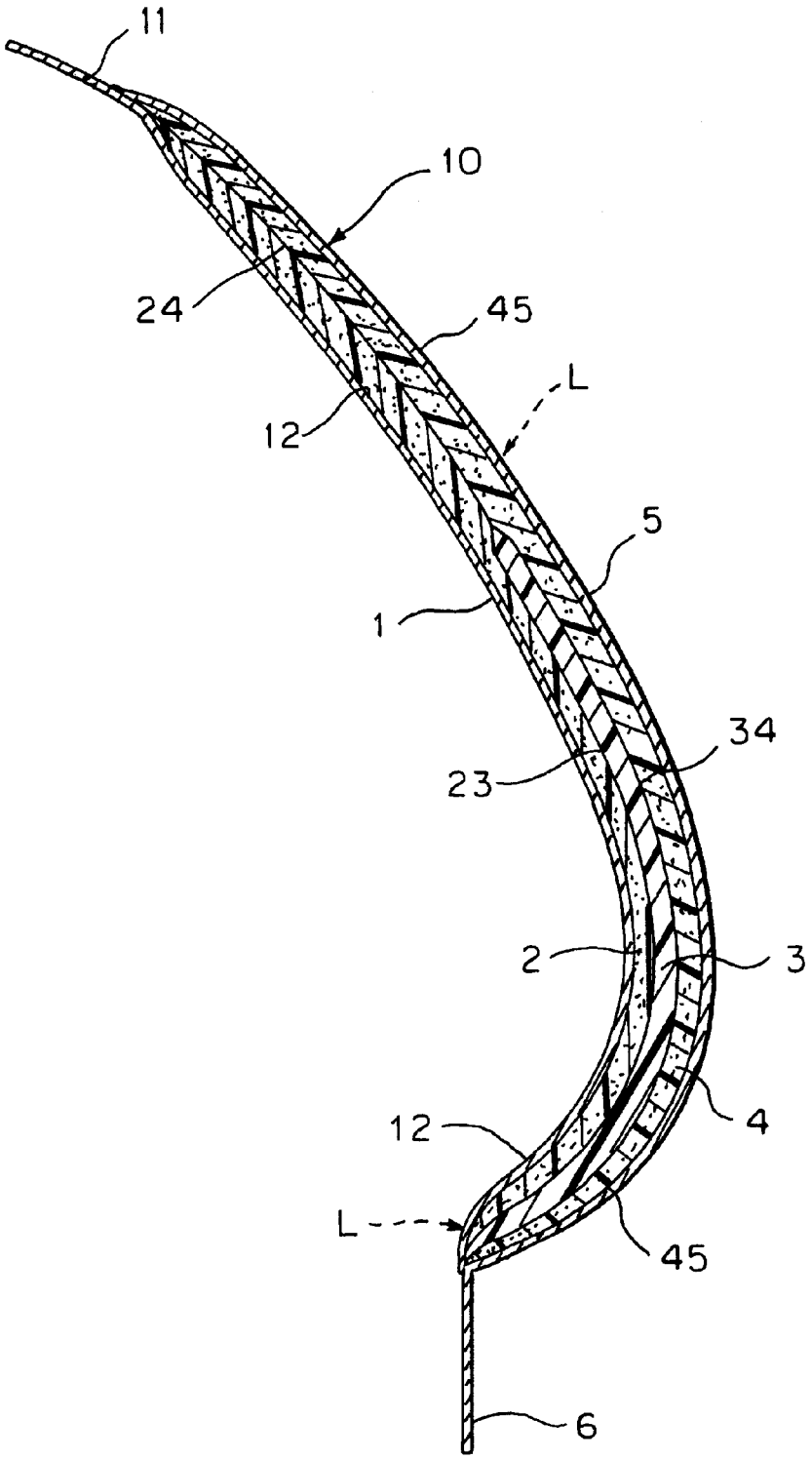
FIG. 2 is a cross-sectional view of the invention.

FIG. 2 shows the structure of FIG. 1 in a vertical cross-section across one of the cups. The adhesive layers 12, 23, 34, and 45 are shown in between the layers 1, 2, 3, 4, and 5 in the area of the rigid cup 3; in the area of the strap 10, where the rigid plastic cup 3 is omitted from the laminate sandwich, preferably there are three layers of adhesive: the two layers 12 and 45 which bond the outer fabric to the foam, and a third layer 24 bonding the inner layer of closed-cell foam 2 directly to the outer layer of closed-cell foam 4. FIG. 2 also shows the position of the dashed line L of FIG. 1.

The inner and outer layers 1 and 5, which contain the inner sandwich 2/3/4, are preferably stretchable, breathable high-modulus knitted fabric, for example, micro-denier nylon/spandex tricot. Spandex in the generic name for fibers based on elastomeric urethane polymers.

The inner sandwich or laminate includes the two layers of closed-cell foam 2 and 4 and the inner hard cup 3, which is preferably of high-density polyethylene and preferably is 1.5 mm thick.

The cups 3 are held permanently inside the outer nylon layers 1, 5, and the foam layers 2,4. Because of the waterproof seal around the cups, and between the layers of the laminate, neither the cups nor the foam need be removed for drying. There are no zippers, VELCRO, snaps, etc., to create an opening or pocket between the two nylon layers.

As discussed above, the inner layer of foam 2 should have a large area, covering the entire breast area, over which compressive force may be applied comfortably. The extensions which run up toward the shoulders and around the ribs increase the area and add somewhat to the impact protection.

The brassiere of the present invention can be worn alone, without any additional covering clothing.

While the brassiere construction of the present invention preferably includes both the outer layers of sheath 5 and foam 4, and the inner layers of sheath 1 and foam 2, the construction may also comprise two-layer laminates with the rigid cup and a single shock-absorbing foam layer. In the latter, the shock-absorbing layer can be on either the inside or the outside of the cup, but preferably is on the inside. The construction may also comprise a multiple-layer laminate with more than one rigid cup stratum, e.g., a laminate of closed-cell foam adjacent the breast, rigid cup, foam, rigid cup, and, optionally, an outer foam layer.

The outer and inner fabric layers 1 and 5 can be omitted and the straps 10 and/or rib band 6 can be fastened directly to the laminate, either to the foam or the rigid material (this embodiment is not shown in the drawing). Preferably, if the outer fabric is omitted, the foam layer is internally reinforced with a layer of scrim, preferably molded in, to improved durability. Also, a single outer fabric layer can be provided for appearance, or a single inner layer for comfort. The inner surface of the foam can be treated to be smooth, as in a wet suit, and comfortably worn next to the skin. While a seam is shown between the right and left breast portions, the fabric and foam layers may be continuous from one side to the other.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention. Thus the expressions "means to . . . " and "means for . . . " as may be found in the specification above and/or in the claims below, followed by a functional statement, are intended to define and cover whatever structural, physical, chemical or electrical element or structure may now or in the future exist for carrying out the recited function, whether or not precisely equivalent to the embodiment or embodiments disclosed in the specification above; and it is intended that such expressions be given their broadest interpretation.

What is claimed is:

1. A unitary brassiere comprising straps and a breast-covering portion, the breast-covering portion further comprising a waterproof protective laminate comprising:

a generally breast-shaped rigid cup having an inside surface, nearest the breast when in use, and an outside surface, and a first foam layer of closed-cell plastic foam adhered to the inside surface of said rigid cup to cover the inside surface entirely.

2. The brassiere according to claim 1, further comprising a second foam layer of closed-cell plastic foam adhered to the outer surface of said rigid cup.

3. The brassiere according to claim 2, wherein said first foam layer and said second foam layer extend beyond a periphery of said rigid cup and are adhered together with, waterproof adhesive around the periphery of said rigid cup.

4. The brassiere according to claim 1, further comprising a first fabric layer covering a surface of the protective laminate, wherein the fabric layer is attached to the straps.

5. The brassiere according to claim 4, further comprising a second fabric layer covering an opposite surface of the protective laminate.

6. The brassiere according to claim 4, wherein the fabric layer is bonded to the protective laminate.

7. The brassiere according to claim 3, further comprising a first fabric layer attached to the straps and covering the inside or the outside surface of the protective laminate.

8. The brassiere according to claim 7, further comprising a second fabric layer covering an opposite surface of the protective laminate.

9. The brassiere according to claim 8, wherein said fabric layers are bonded to the adjacent foam layers.

10. The brassiere according to claim 1, wherein said layer of plastic foam is adhered to said rigid cup by means of a waterproof adhesive.

11. The brassiere according to claim 1, wherein said laminate comprises a pair of separate rigid cups, further comprising an integral left cup and an integral right cup.

12. The brassiere according to claim 11, wherein each said rigid cup extends from a wearer's breast region toward a wearer's shoulder region.

13. The brassiere according to claim 12, wherein each said rigid cup further extends from a wearer's breast region laterally around a wearer's rib region.

14. The brassiere according to claim 1, further comprising an anchoring band attached at a lower side of said breast-covering portion; said straps including back straps adapted to extend around a user's chest to a wearer's backside, and including mating backside fasteners at respective ends of the back straps; said back straps being attached to the anchoring band; whereby the anchoring band is secured about the user's chest to support said breast-covering portion.

15. A method of protecting a breast from impact, comprising:

providing a rigid cup of a size to be completely filled with breast tissue of the breast, said cup being lined with an inner layer of energy-absorbing closed-cell foam; and placing the cup onto the breast so that breast tissue fills the cup completely, whereby an impact creates pressure in the breast and the foam absorbs energy by being compressed.

16. The method according to claim 15, wherein said rigid cup further includes an outer layer of energy-absorbing closed-cell foam.

17. A unitary brassiere comprising straps and a breast-covering portion, the breast-covering portion further comprising a waterproof protective laminate comprising:

a generally breast-shaped rigid cup having an inside surface, nearest the breast when in use, and an outside surface, and a foam layer of closed-cell plastic foam adhered to the outside surface of said rigid cup to cover the outside surface entirely.

* * * * *